United States Patent [19]

Konose

[11] Patent Number: 5,035,525

[45] Date of Patent: Jul. 30, 1991

[54] LIQUID APPLICATOR

[75] Inventor: Yoshiomi Konose, Fujioka, Japan

[73] Assignee: Mitsubishi Pencil Co., Ltd., Tokyo, Japan

[21] Appl. No.: 442,457

[22] Filed: Nov. 30, 1989

Related U.S. Application Data

[63] Continuation of Ser. No. 268,609, Nov. 7, 1988, abandoned, which is a continuation of Ser. No. 19,394, Feb. 26, 1987, abandoned.

[30] Foreign Application Priority Data

Feb. 27, 1986 [JP] Japan ..... 61-29003[U]

[51] Int. Cl.[5] ..... A46B 11/00

[52] U.S. Cl. ..... 401/278; 401/205; 401/273; 401/279

[58] Field of Search ..... 401/272, 273, 278, 279, 401/206, 205

[56] References Cited

U.S. PATENT DOCUMENTS 1,044,395 11/1912 Kenady ..... 401/278

1,138,772 5/1915 Matthews ..... 401/273

3,589,824 6/1971 Andrews et al. ..... 401/206

*Primary Examiner*—Steven A. Bratlie

*Attorney, Agent, or Firm*—Armstrong, Nikaido, Marmelstein, Kubovcik & Murray

[57] ABSTRACT

An outer shaft of an applicator axially slidably receives an inner shaft, which is axially moved through a push-out operation thereof; and the inner shaft is provided a valve unit, an opening/closing operation of which is interlocked with such push-out operation of the inner shaft, which valve unit is connected with an application-liquid intake conduit fixed to an inside of the outer shaft; in a front end portion of the outer shaft is mounted an application-liquid applying member to which is fed the application-liquid such as an ink, a nail polish and like liquids having passed through the valve unit and the application-liquid intake conduit. A clearance is provided between a front end of the valve stem of the valve unit and the rear end of the application-liquid intake conduit, and a spring means is provided between the liquid intake conduit and the outer main shaft to compensate for undesired looseness.

2 Claims, 2 Drawing Sheets

LIQUID APPLICATOR

This application is a continuation of application Ser. No. 268,609 filed Nov. 7, 1988, now abandoned, which was a continuation of application Ser. No. 019,394 filed Feb. 26, 1987, now abandoned.

BACKGROUND OF THE INVENTION

1. Field of the Invention

The present invention relates to a liquid applicator in which: an outer shaft axially slidably receives an inner shaft which is axially moved through a push-out operation thereof; in the inner shaft is provided a valve unit an opening/closing operation of the valve unit is interlocked with the push-out operation of the inner shaft, and the valve unit is connected with an application-liquid intake conduit fixed to an inside of the outer shaft. In a front end portion of the outer shaft is mounted an application-liquid applying member to which is fed the application liquid such as an ink, a nail polish and like liquids having passed through the valve unit and the application-liquid intake conduit.

2. Description of the Prior Art

Hitherto, in such a type of a conventional liquid applicator, when the inner shaft is advanced through its push-out operation, a valve stem of the valve unit abuts on the application-liquid intake conduit so as to be prevented from moving forward so that the valve stem is moved rearward relative to the inner shaft to open the valve unit. In this conventional liquid applicator, in order to prevent the valve stem or valve from being opened at a time when a push-rod for conducting the push-out operation of the inner shaft is subjected to a slight accidental shock, there is provided a certain clearance between a front end of the valve stem of the valve unit and a rear end of the application-liquid intake conduit so as to avoid an immediate collision therebetween. However, such clearance makes the inner shaft loose and deteriorates a reliable feeling regarding the liquid applicator in use. This is a serious defect in the conventional liquid applicator.

SUMMARY OF THE INVENTION

It is an object of the present invention to provide a liquid applicator in which a clearance is provided between a front end of a valve stem of a valve unit and a rear end of an application-liquid intake conduit without making the inner shaft loose by the use of a means for preventing the inner shaft from being loose.

According to the present invention, there is provided: a liquid applicator in which: an outer shaft axially slidably receives an inner shaft which is axially moved through a push-out operation thereof; and said inner shaft is provided with a valve unit, an opening/closing operation of which is interlocked with said push-out operation of said inner shaft, said valve unit being connected with an application-liquid intake conduit fixed to an inside of said outer shaft. In a front end portion of said outer shaft is mounted an application-liquid applying member to which is fed said application liquid such as an ink, a nail polish and like liquids having passed through said valve unit and said application-liquid intake conduit. The improvement comprises: a spring means interposed between a front portion of said inner shaft and an inner surface of a front end of said outer shaft.

Such spring means is preferably constructed of a coil spring.

DESCRIPTION OF THE PREFERRED EMBODIMENT

Figure 1:
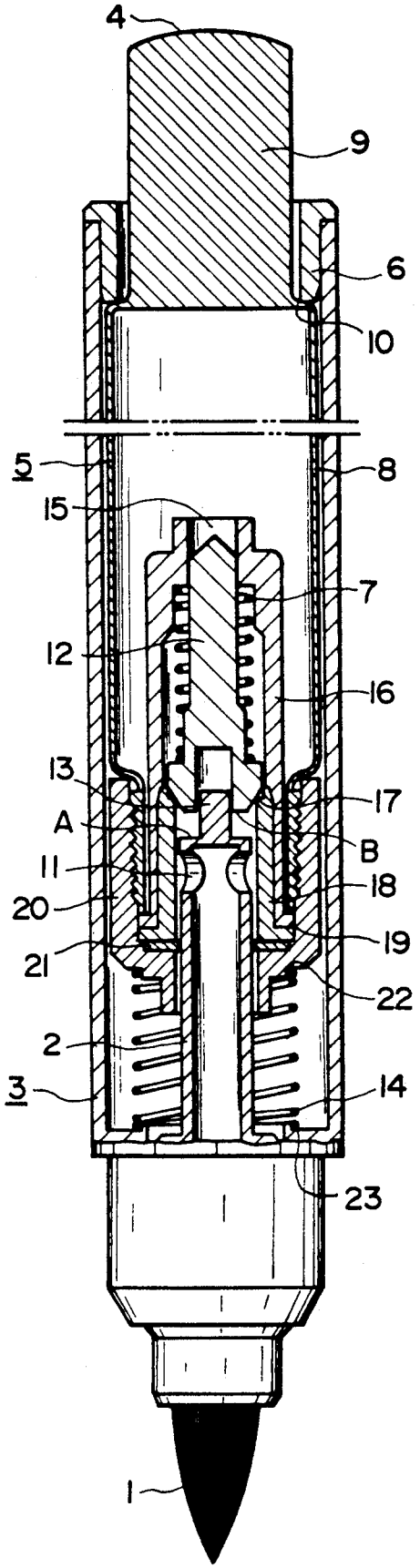
FIG. 1 is a longitudinal sectional view of a pen-type writing brush of the present invention, in a condition in which the push-out operation of the writing brush is not being conducted.

Hereinbelow, the present invention will be described in detail with reference to the drawings. However, it is clear that the present invention is not limited to the embodiment thereof shown in the drawings.

The drawings show a pen-type writing brush embodying the present invention.

In an embodiment of the writing brush shown in the drawings, a brush-like pen-core 1, which is an application-liquid applying member, receives an application-liquid or ink from an application-liquid intake conduit 2 which is mounted in a front portion of an outer shaft or main body 3 of the writing brush in a manner that the application-liquid intake conduit 2 is fixed to the front end of the main body 3 of the writing brush and projects therefrom, rearward beyond an axial center portion of the main body 3 of the writing brush. An inner shaft or ink-reservoir 5 of the writing brush is provided with an opening at its front portion and also provided with a push-rod 4 at its rear end, and a front portion of which ink-reservoir 5 has incorporated a valve unit. In assembling of the writing brush, the inner shaft or ink-reservoir 5, in which is incorporated the valve unit, is inserted into the main body 3 of the writing brush from its rear end so that the application-liquid intake conduit 2 is operationally connected with the valve unit of the ink-reservoir 5, which is a cartridge-type member to make itself detachable from the main body 3 of the writing brush for replacement purposes.

After inserting the inner shaft or ink-reservoir 5 into the main body 3 of the writing brush, a fitting ring member 6 is fixed to a rear end portion of the main body 3 of the writing brush. The inner shaft or ink-reservoir 5 is always urged rearward relative to the outer shaft or main body 3 of the writing brush under the influence of the resilient force of a coil spring 7 of the valve unit incorporated in the inner shaft or ink-reservoir 5. At this time, since a large-diameter portion 8 of the ink-reservoir 5 is larger in diameter than an inner bore of a fitting ring member 6, such fitting ring member 6 abuts on a shoulder portion 10 formed between the large-diameter portion 8 of the ink-reservoir 5 and a small-diameter rear portion 9 of the same 5 so as to prevent the ink-reservoir 5 from dropping out of the main body 3 of the writing brush, as shown in FIG. 1.

Figure 2:
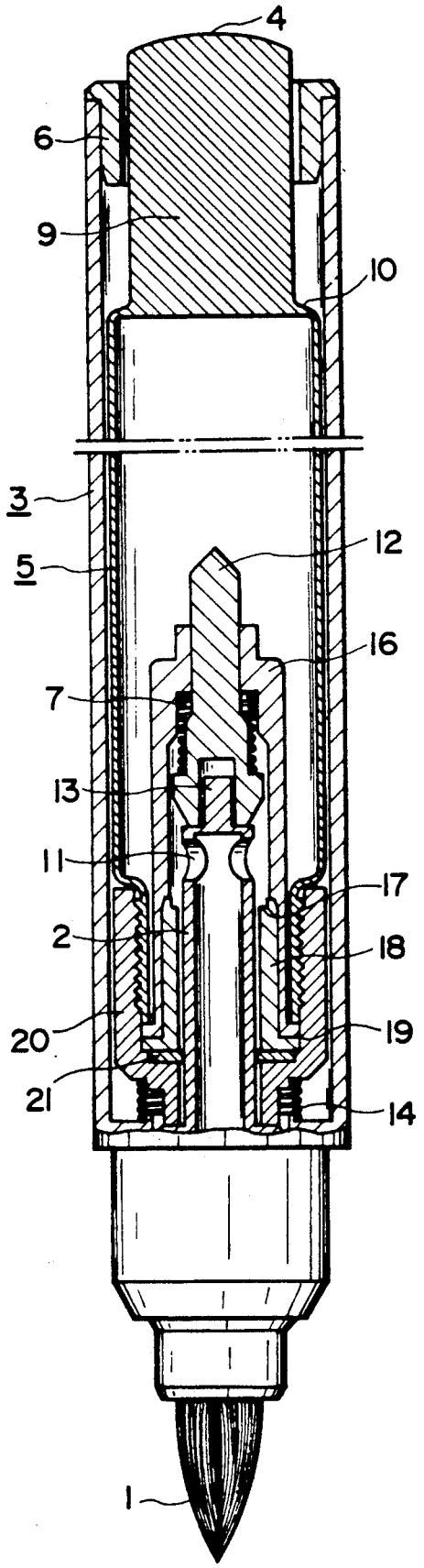
FIG. 2 is a longitudinal sectional view of the writing brush of the present invention, in a condition in which the push-out operation of the writing brush is being conducted.

In operation, the inner shaft or ink-reservoir 5 is pushed at its rear end portion or push-rod 4 forward relative to the outer shaft or main body 3 of the writing brush. When the push-rod 4 is released from the user's finger, the inner shaft or ink-reservoir 5 is moved rearward relative to the outer shaft or main body 3 of the writing brush. Consequently, in conducting the push-out operation, the ink-reservoir 5 is reciprocally moved between its most rearward position shown in FIG. 1 and its most advanced position shown in FIG. 2. Through such reciprocal movement of the inner shaft or ink-reservoir 5 relative to the outer shaft or main body 3 of the writing brush caused by the push-out operation of the inner shaft or ink-reservoir 5, the ink received in the ink-reservoir 5 is forcibly fed to the brush-like pen-core 1 of the writing brush.

More particularly, the application-liquid intake conduit 2, which assumes a tubular form and acts also as a piston rod, is so provided that the conduit 2 extends from the front end portion of the outer shaft or main body 3 rearwardly. In the vicinity of the rear end of the application-liquid intake conduit 2 are provided an ink-communication hole 11 and a projection 13 which supports a valve stem 12 of the valve unit provided in the ink-reservoir 5.

In a front end of the main body 3 of the writing brush is provided the brush-like pen-core 1 to which the application liquid or ink is fed from the application-liquid intake conduit 2. Such pen-core 1 is known in construction so that it is not described here in detail.

The valve unit provided in the front end portion of the inner shaft or ink-reservoir 5 consists of: a valve casing/cylinder 16 provided with an ink-communication hole (not shown) and a valve-stem guiding bore or hole 15; a valve body/piston/valve stem 12 which is mounted in the valve casing/cylinder 16 and always urged forward by means of the coil spring 7; and a tubular element 18 which is inserted into a front end portion of the valve casing/cylinder 16 and fixed thereto to form a shoulder portion or a valve seat 17.

The valve unit is provided with a radially outwardly directed flange 19 at its front end. Such flange 19 abuts on a front end of the inner shaft 5 to prevent the valve unit from dropping in the inner shaft 5. A lid element 20 is threadably connected to a front end of the inner shaft 5 to clamp the flange 19 of the valve unit therebetween, so that the valve unit is fixed to the inner shaft 5. Between the flange 19 of the valve unit and the lid element 20 is clamped a ring-like packing 21 which cooperates with an outer surface of the application-liquid intake conduit 2 to prevent leakage of the ink therebetween.

In assembling, when the inner shaft or ink-reservoir 5 is mounted in the outer shaft or main body 3 of the writing brush, a certain clearance is provided between a front end "B" of the valve stem 12 of the valve unit and a rear end "A" of the application-liquid intake conduit 2 for supporting the valve stem 12 so as to provide a play to the valve stem 12.

By the provision of such play, it is possible to prevent the valve unit from being operated at a time when an accidental slight pushing force is applied to the inner shaft or ink-reservoir 5. However, if such play is simply provided to the valve stem 12, such play deteriorates from a reliable feeling of the inner shaft or ink-reservoir 5 when its push-out operation is conducted. Consequently, such play above is not preferable in use.

In order to eliminate the defect of or looseness the play of the valve stem 12 of the valve unit, according to the present invention, a coil spring 14 is provided between a front end shoulder portion of the lid element 20 threadably connected to the front end portion of the inner shaft or ink-reservoir 5 and a shoulder portion 23 formed in an inner surface of a front end of the outer shaft or main body 3 of the writing brush, which coil spring 14 exerts its resilient force on the lid element 20 to the extent that such resilient force does not affect the smoothness of the push-out operation of the inner shaft 5. The coil spring 24 is not fully compressed even when the inner shaft 5 reaches its most advanced position in its push-out operation.

Under the influence of such resilient force of the coil spring 24, the inner shaft or ink-reservoir 5 is always urged rearward relative to the outer shaft or main body 3 of the writing brush, so as to abut on the fitting ring-like member 6 at its rear end portion, to make it possible that the inner shaft or ink-reservoir 5 is held steady in the outer shaft or main body 3 of the writing brush. As a result, it is possible to prevent the inner shaft or ink-reservoir 5 from being loose at a time when the push-out operation of the inner shaft or ink-reservoir 5 is not conducted, so that a reliable feeling of the inner shaft or ink-reservoir 5 is obtained. This is an important effect of the present invention.

What is claimed is:

1. A liquid applicator which comprises:

a) a main hollow shaft;

b) an inner shaft slidably mounted in said main shaft, being hollow to provide a liquid reservoir and terminating at its rearward end in a push rod extending beyond said main shaft;

c) a liquid conduit secured to said main shaft and extending rearwardly through a neck of said inner shaft with an opening into the conduit adjacent its rearward end and its forward end being in communication with a liquid applicator;

d) a hollow casing extending rearwardly through the neck of said inner shaft;

e) a tubular element in said casing terminating at its rearward end in a valve seat;

f) a valve stem and body slidably mounted on a rear cylindrical end portion of said liquid conduit with its rearward end slidably mounted in said hollow casing and its forward end comprising a valve body for seating on said valve seat of said tubular element;

g) a lid member at the forward end of said inner shaft securing said tubular element and said casing to said inner shaft;

h) said liquid conduit having a projection at its rearward end slideably fitting into a closed bore on the forward end of the valve body, the opening into said liquid conduit being at a predetermined spaced distance from said valve seat whereby said valve body is not lifted from said valve seat until said hollow casing, tubular element, valve stem and body and inner shaft travel through a distance equal to said predetermined spaced distance;

i) a spring means between said hollow casing and said valve body to urge said valve body against the valve seat of said tubular body element; and j) a second spring means between said lid member and an interim shoulder of said main shaft to urge said inner shaft in a rearward direction and return the movement of said push rod to its rearward position as well as to ensure that only positive movement of said inner shaft greater that said predetermined spaced distance would result in moving said valve body off of said valve seat to open said liquid conduit for communication between said reservoir and said applicator.

2. A liquid applicator as claimed in claim 1, wherein each of said first and second spring means comprises a coil spring.

* * * * *